US007743954B2

(12) United States Patent
Chiu

(10) Patent No.: US 7,743,954 B2
(45) Date of Patent: Jun. 29, 2010

(54) RETRACTABLE CLOTHES HANGER

(76) Inventor: Lu-Ying Chiu, 1F., No. 135, Lane 75, Sec. 3, Kangning Rd., Neihu District, Taipei 114 (TW)

( * ) Notice: Subject to any disclaimer, the term of this patent is extended or adjusted under 35 U.S.C. 154(b) by 0 days.

(21) Appl. No.: 12/167,424

(22) Filed: Jul. 3, 2008

(65) Prior Publication Data

US 2009/0039116 A1 Feb. 12, 2009

(30) Foreign Application Priority Data

Aug. 8, 2007 (TW) ..... 96213032 U

(51) Int. Cl.
*A41D 27/22* (2006.01)

(52) U.S. Cl. ..... 223/89; 223/94

(58) Field of Classification Search ..... 223/85, 223/88, 89, 92, 94, 95
See application file for complete search history.

(56) References Cited

U.S. PATENT DOCUMENTS 958,366 A * 5/1910 Clausen ..... 223/89
1,111,147 A * 9/1914 Fogde ..... 223/89
1,886,869 A * 11/1932 Button ..... 223/94
2,290,722 A * 7/1942 Weingarten ..... 223/94
2,654,484 A * 10/1953 Win et al. ..... 223/89
2,754,038 A * 7/1956 Varker ..... 223/94
4,227,632 A * 10/1980 Collis ..... 223/94
5,826,759 A * 10/1998 Ohsugi ..... 223/89

* cited by examiner

*Primary Examiner*—Gary L Welch
*Assistant Examiner*—Nathan E Durham
(74) *Attorney, Agent, or Firm*—Alan Kamrath; Kamrath & Associates PA

(57) ABSTRACT

A clothes hanger includes a hanging rod and a linkage mechanism. The hanging rod includes a hanging unit and a guiding rod with its upper end connected to the hanging unit. The linkage mechanism includes a sliding unit, a first linkage arm, and a second linkage arm. The sliding unit is affixed in an up-down slidable manner to the guiding rod. The first linkage arm is installed at a left side of the guiding rod, and the first linkage arm has a first end connected to the sliding unit and a second end connected to a lower end of the guiding rod. The second linkage arm is installed at a right side of the guiding rod, and the second linkage arm has a first end connected to the sliding unit and a second end connected to the lower end of the guiding rod.

20 Claims, 10 Drawing Sheets

RETRACTABLE CLOTHES HANGER

BACKGROUND OF THE INVENTION

1. Field of the Invention

The present invention relates to a clothes hanger and, more particularly, to a retractable clothes hanger.

2. Description of the Related Art

Please refer to FIG. 1. FIG. 1 is an illustration of a conventional clothes hanger 100 holding clothes 110. The clothes hanger 100 comprises a hook 102 and a hanging frame 104. The clothes hanger 100 can be hung on a clothes drying rope or a clothes drying pole by the hook 102. The hanging frame 104 is connected to the hook 102 for hanging clothes 110.

However, the wingspan of the hanging frame 104 of the conventional clothes hanger 100 is much bigger than the opening of neckline 112 of the clothes 110 in order to prevent the clothes 110 from falling off. When the user is trying to hang the clothes 110, the neckline 112 of the clothes 110 needs to be stretched wide enough for the the hanging frame 104 to be inserted into the clothes 110. Similarly, when the user is trying to remove the clothes 110 from the hanging frame 104, the neckline 112 of the clothes 110 needs to be stretched again in order to remove the hanging frame 104 from the clothes 110.

To insert the conventional clothes hanger 100 into the clothes 110, the user needs to stretch the neckline 112 of the clothes 110 with both hands, which causes some inconvenience in use. In addition, the neckline of the clothes 110 will be loosened and deformed by the frequent stretching.

SUMMARY OF THE INVENTION

It is therefore an objective of the present invention to provide a retractable clothes hanger in order to solve the problems of the prior art.

The clothes hanger of the present invention comprises a hanging rod and a linkage mechanism. The hanging rod comprises a hanging unit and a guiding rod with its upper end connected to the hanging unit. The linkage mechanism comprises a sliding unit, a first linkage arm, and a second linkage arm. The sliding unit is affixed to the guiding rod in an up-down slidable manner. The first linkage arm is installed at a left side of the guiding rod, and the first linkage arm has a first end connected to the sliding unit and a second end connected to a lower end of the guiding rod. The second linkage arm is installed at a right side of the guiding rod, and the second linkage arm has a first end connected to the sliding unit and a second end connected to the lower end of the guiding rod. When the sliding unit is moved to a first position corresponding to the guiding rod, the linkage mechanism is in a closed-state, and when the sliding unit is moved to a second position corresponding to the guiding rod, the linkage mechanism is in an open-state for hanging clothes.

Other objectives, advantages, and novel features of the present invention will become more apparent from the following detailed description when taken in conjunction with the accompanying drawings.

BRIEF DESCRIPTION OF THE DRAWINGS

These and other objectives and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
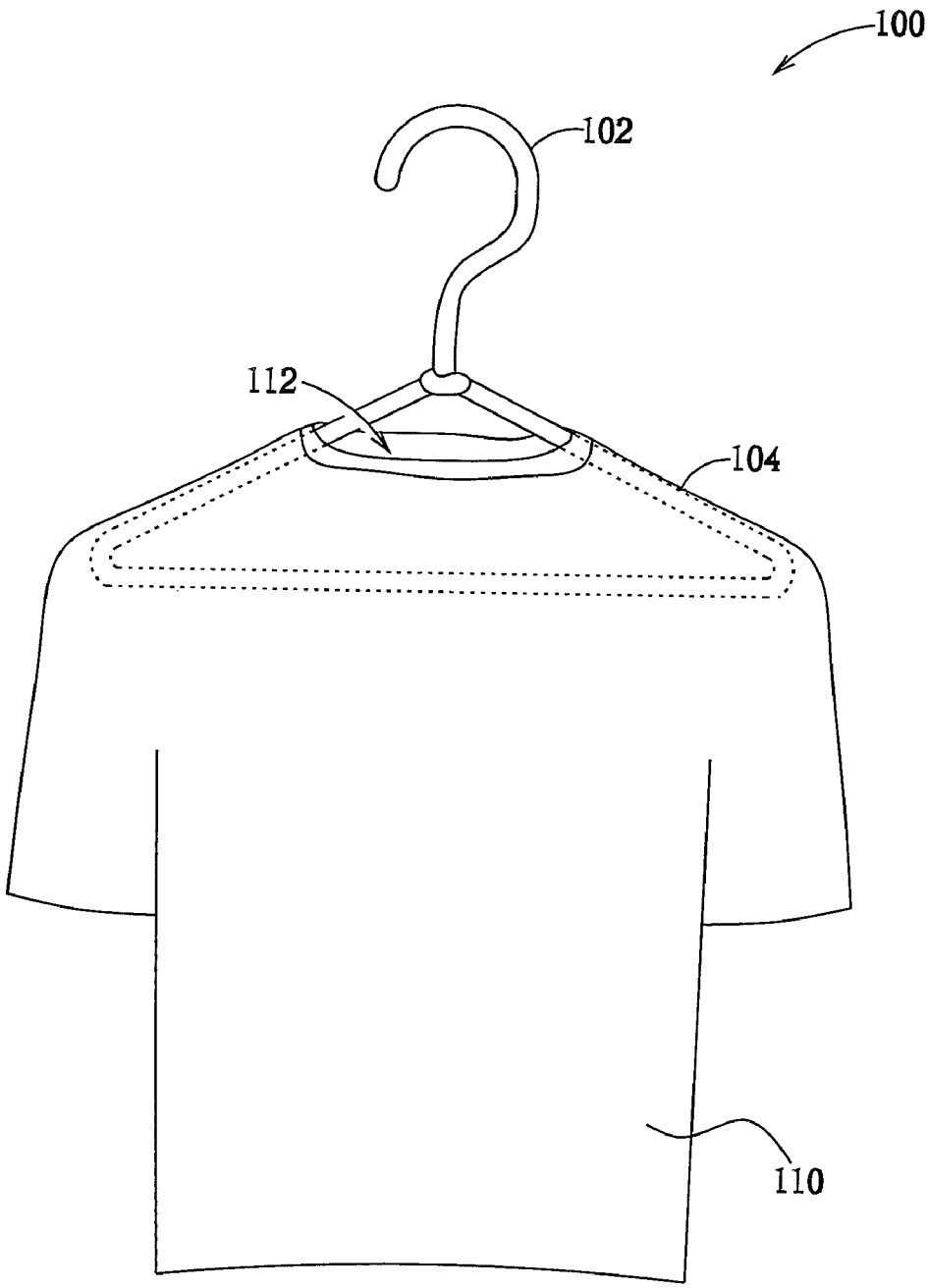
FIG. 1 (Prior Art)
FIG. 1 is an illustration of a conventional clothes hanger hanging clothes.
Figure 2:
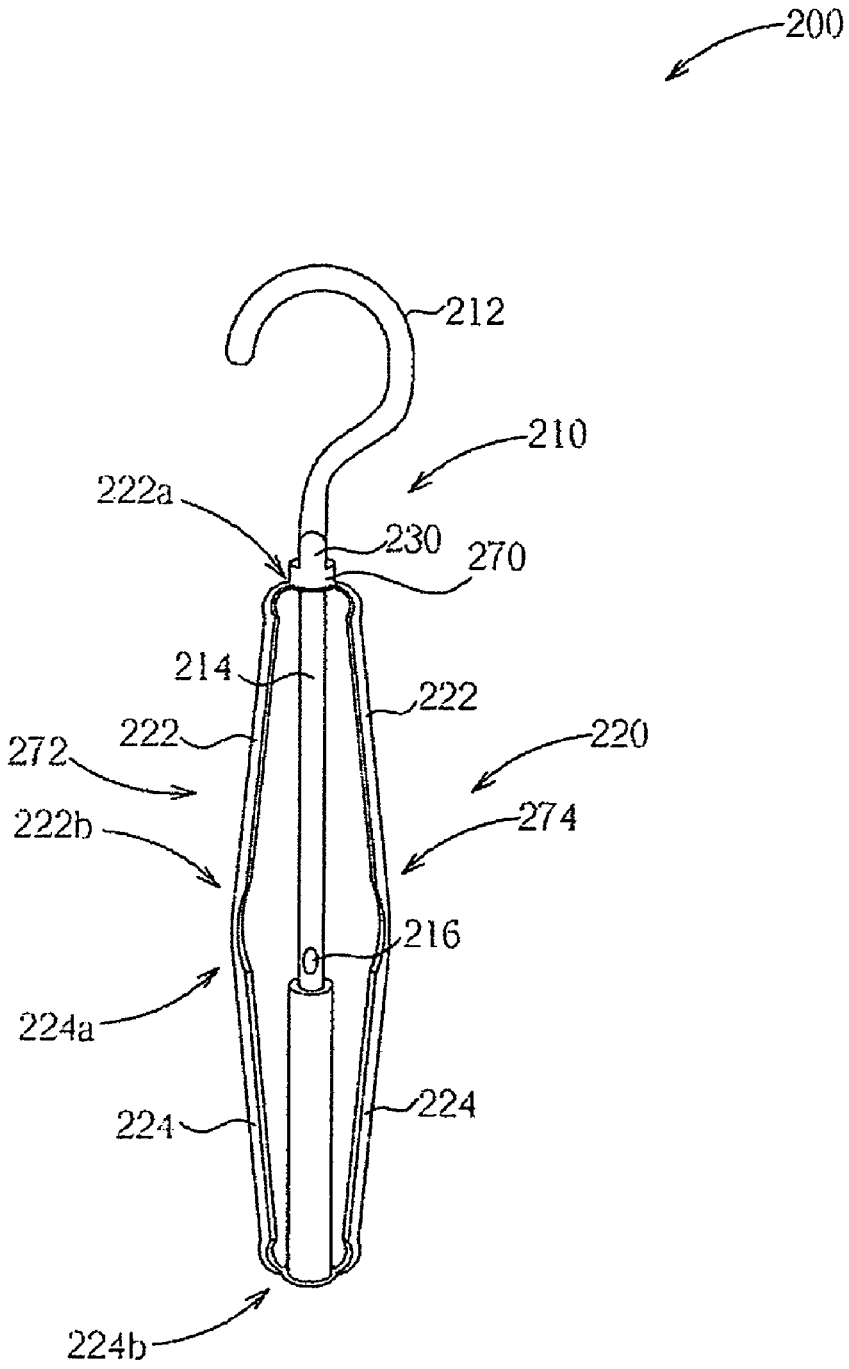
FIG. 2 is an illustration of a retractable clothes hanger of the present invention.
Figure 3:
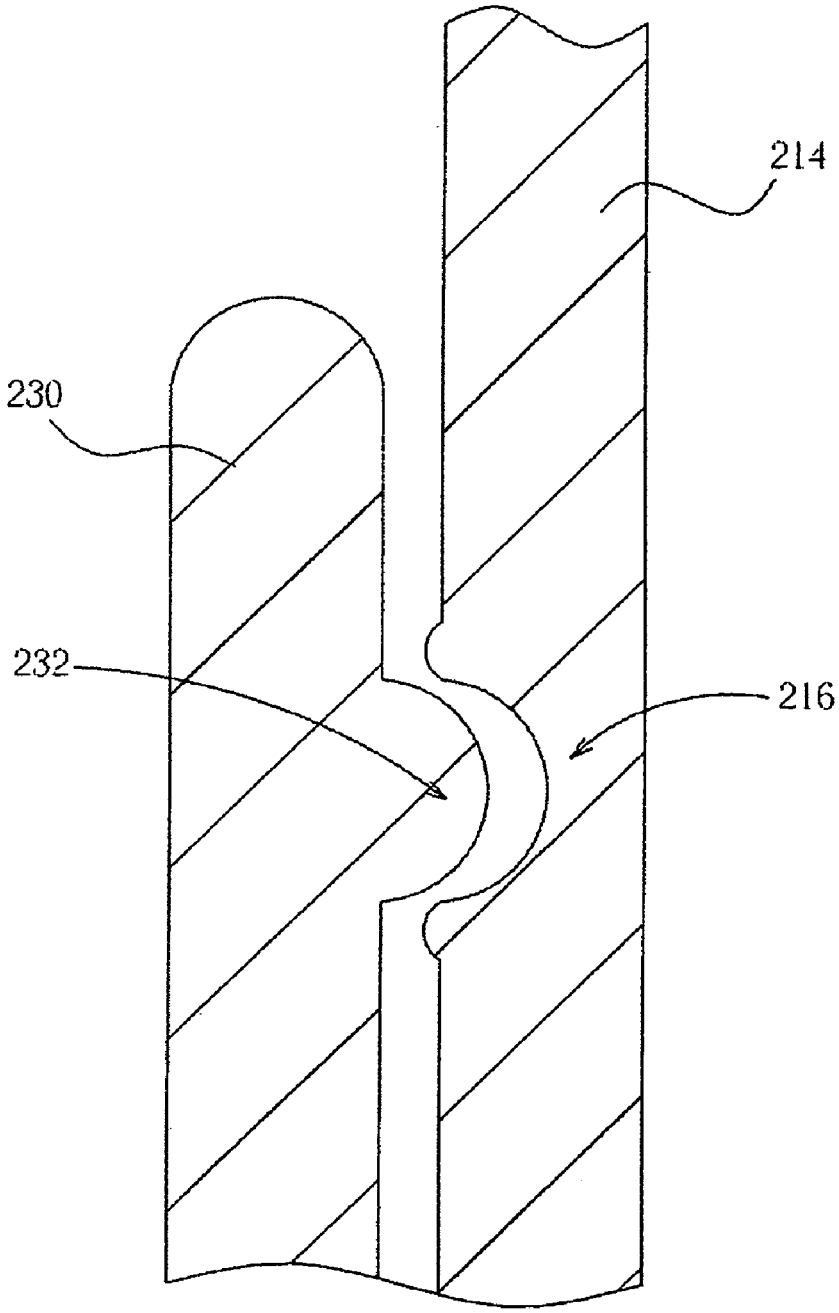
FIG. 3 is a cross-section view of a fixing unit of the clothes hanger shown in FIG. 2.

Please refer to FIG. 2 and FIG. 3. FIG. 2 is an illustration of a retractable clothes hanger 200 of the present invention. FIG. 3 is a cross-section view of a fixing unit 230 of the clothes hanger 200 in FIG. 2. The clothes hanger 200 comprises a hanging rod 210 and a linkage mechanism 220. The hanging rod 210 comprises a hanging unit 212 and a guiding rod 214. In the embodiment of FIG. 2, the hanging unit 212 is a hook for hanging the clothes hanger 200 on a clothes drying rope or a clothes drying pole. However, the hanging unit 212 can also be a hanging strip or other design with similar function. An upper end of the guiding rod 214 is connected to the hanging unit 212. The guiding rod 214 can be a straight pole or other similar object. The linkage mechanism 220 comprises a sliding unit 270, a first linkage arm 272, and a second linkage arm 274. The sliding unit 270 is affixed in an up-down slidable manner to the guiding rod 214. The first linkage arm 272 is installed at a left side of the guiding rod 214, and the second linkage arm 274 is installed at a right side of the guiding rod 214. Both the first linkage arm 272 and the second linkage arm 274 comprise a sub-upper arm 222 and a sub-lower arm 224. First ends 222*a* of the sub-upper arms 222 (also first ends of the first and second linkage arms 272, 274) are connected to the sliding unit 270. Second ends 224*b* of the sub-upper arms 222 are connected to first ends 224*a* of the sub-lower arms 224. Also, second ends 224*b* of the sub-lower arms 224 (and second ends of the first and second linkage arms 272, 274) are connected to a lower end of the guiding rod 214. The sliding unit 270, the sub-upper arms 222, and the sub-lower arms can be connected to each other by hinges or other similar knuckle mechanisms. However, in the present embodiment, the linkage mechanism 220 is monolithic, and folding areas between the sliding unit 270, the sub-upper arms 222, and the sub-lower arms 224 are thinned out, such that the number of molds for injection molding can be reduced.

In addition, the clothes hanger 200 further comprises a fixing unit 230 for fixing the sliding unit 270 at a specific position of the guiding rod 214. As shown in FIG. 3, the fixing unit 230 has a bump 232, and the guiding rod 214 has a corresponding recess 216. When the bump 232 of the fixing unit 230 is moved and stuck in the recess 216 of the guiding rod 214, the sliding unit 270 will be fixed on the guiding rod 214 until the sliding unit 270 is forced again to move the bump 232 of the fixing unit 230 out of the recess 216 of the guiding rod 214. However, the fixing unit 230 shown in FIG. 3 is just one of the embodiments of the present invention. The fixing unit 230 can be other kinds of designs. For example, the fixing unit 230 can also use friction, magnetic force, gravity, etc. to fix the sliding unit 270.

Figure 4:
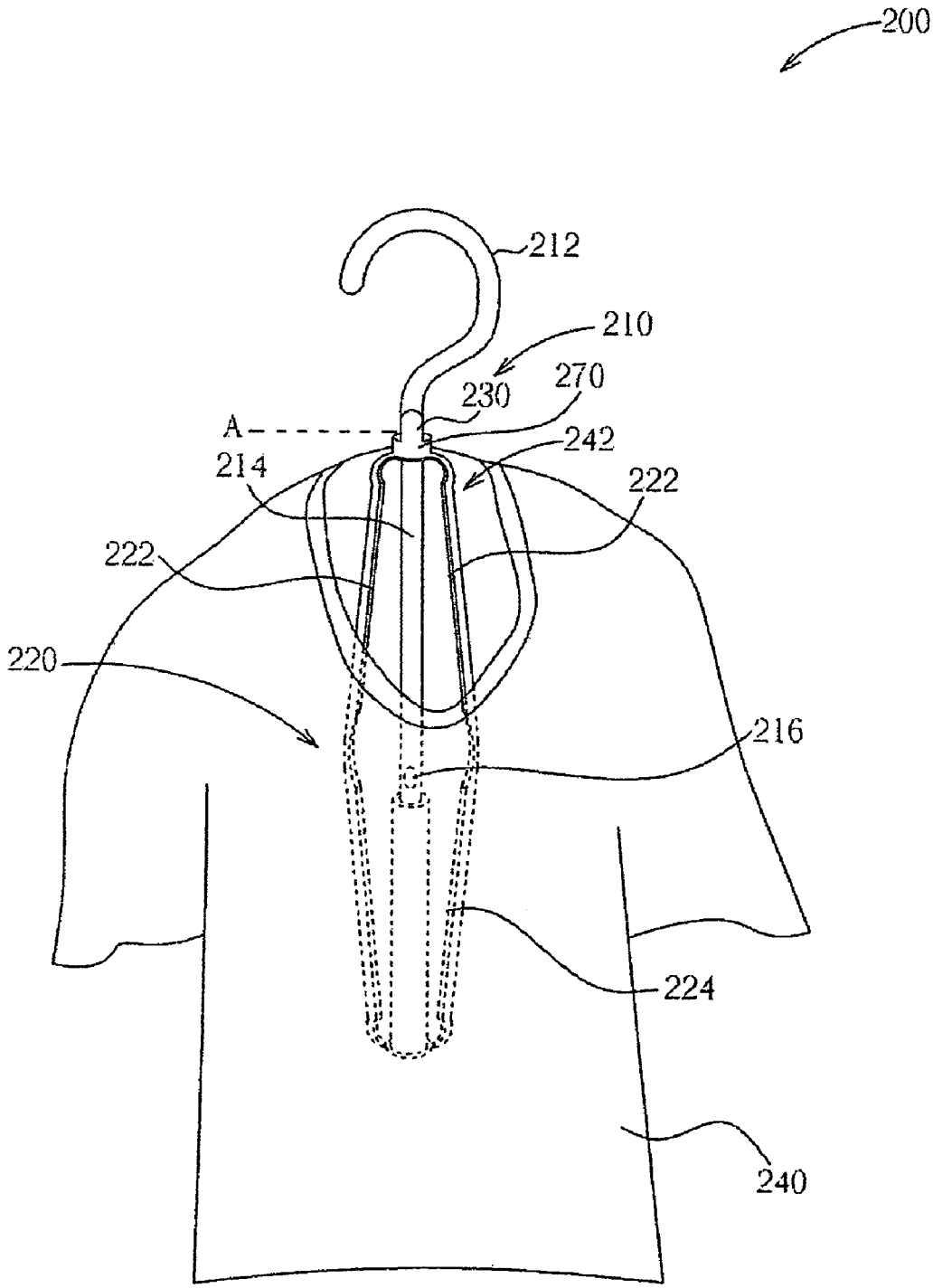
FIG. 4 is an illustration of clothes before being hung by the clothes hanger shown in FIG. 2.
Figure 5:
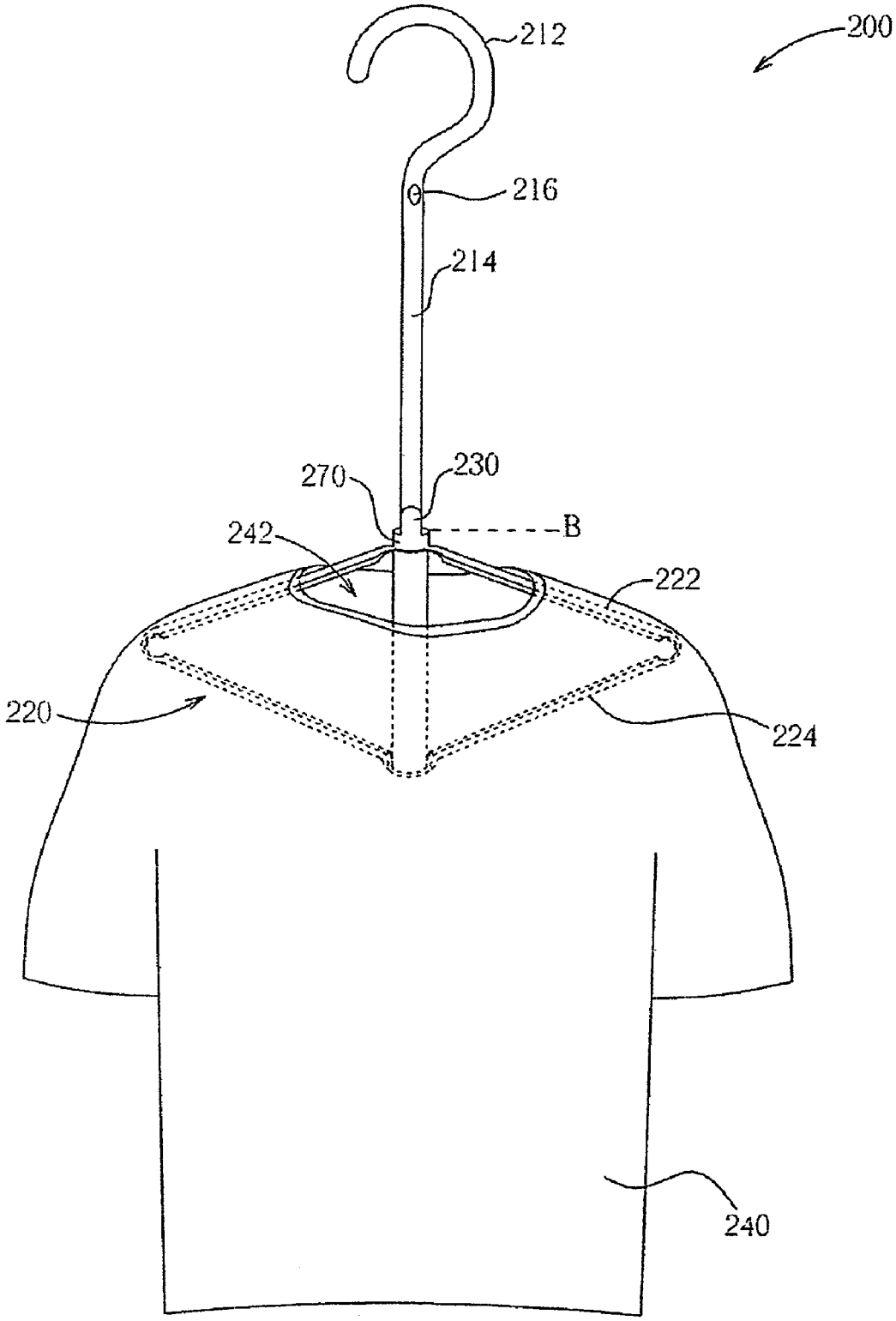
FIG. 5 is an illustration of the clothes after being hung by the clothes hanger shown in FIG. 2.

Please refer to FIG. 4 and FIG. 5, and refer to FIG. 2 and FIG. 3 as well. FIG. 4 is an illustration of clothes 240 before being hung on the clothes hanger 200 in FIG. 2. FIG. 5 is an illustration of the clothes 240 after being hung by the clothes hanger 200 in FIG. 2. When the sliding unit 270 is at a first position A, the folding areas between the sub-upper arms 222 and the sub-lower arms 224 are close to the guiding rod 214, according to the design of the linkage mechanism 220. Therefore, the wingspan of the linkage mechanism 220 is smaller than the opening of neckline 242, and the clothes hanger 200 is not able to hang the clothes 240. The linkage mechanism 220 is in a closed-state in the first position A. When the sliding unit 270 is moved downward from the first position A, the folding areas between the sub-upper arms 222 and the sub-lower arms 224 gradually move outward according to the design of the linkage mechanism 220. When the sliding unit 270 arrives at a second position B, the folding areas between the sub-upper arms 222 and the sub-lower arms 224 are apart from the guiding rod 214. Therefore, the wingspan of the linkage mechanism 220 is large enough to hang the clothes 240. The linkage mechanism 220 is in an open-state in the second position B. In the present embodiment, the fixing unit 230 is capable of fixing the sliding unit 270 at the first position A or the second position B, to keep the linkage mechanism 220 in a closed-state or an open-state.

As shown in FIG. 4 and FIG. 5, the clothes hanger 200 of the present invention is more convenient than the conventional clothes hanger 100 when hanging and unhanging clothes. For example, when trying to hang the clothes 240 on the clothes hanger 200, the user can put the linkage mechanism 220 in a closed-state through the opening of neckline 242, and then pull the sliding unit 270 downward, thus causing the wingspan of the linkage mechanism 220 to increase as the sliding unit 270 is moved downward till the wingspan of the linkage mechanism 220 is large enough to hang the clothes 240. Correspondingly, when trying to remove the clothes 240 from the clothes hanger 200, the user can move the sliding unit 270 upward, thus causing the wingspan of the linkage mechanism 220 to decrease as the sliding unit 270 is moved upward till the wingspan of the linkage mechanism 220 is small enough to allow removal of the clothes 240. The user needs only to move the sliding unit 270 when hanging and unhanging clothes. Moreover, the clothes hanger 200 of the present invention will not stretch the neckline 242 when being inserted into or removed from the clothes 240. Therefore, the clothes 240 will not be damaged or deformed at the area of the neckline 242 anymore.

Figure 6:
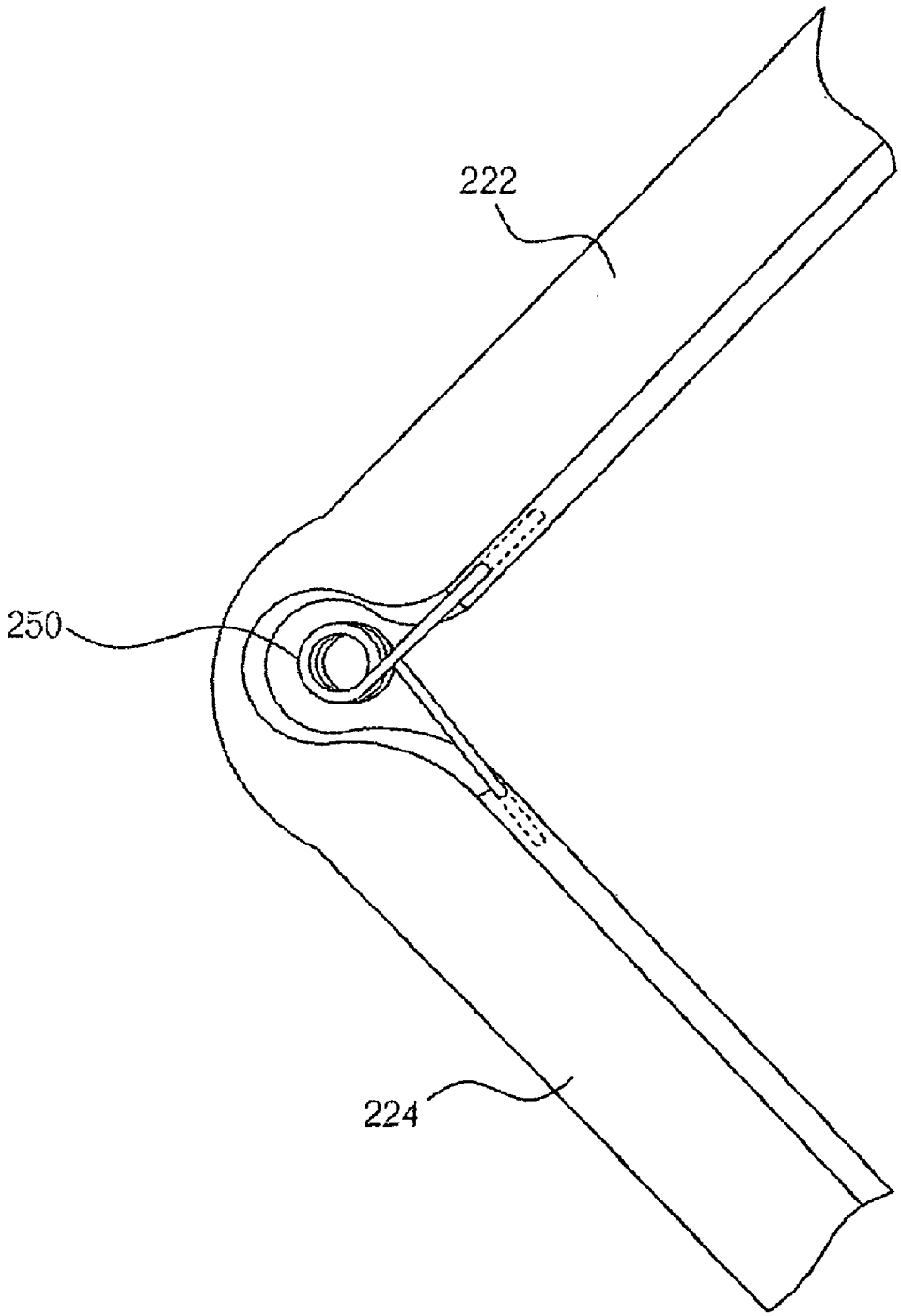
FIG. 6 is an illustration of the clothes hanger shown in FIG. 2 further comprising a spring.

In addition, the clothes hanger 200 can further comprise a spring 250 to move the sliding unit 270 for more convenience. As shown in FIG. 6, the spring 250 is installed at the folding area between the sub-upper arms 222 and the sub-lower arms 224. The spring 250 can provide force to move the sliding unit 270 to the first position A (or the second position B), such that the linkage mechanism 220 can automatically go to the closed-state (or the open-state) when the fixing unit 230 releases the sliding unit 270.

Figure 7:
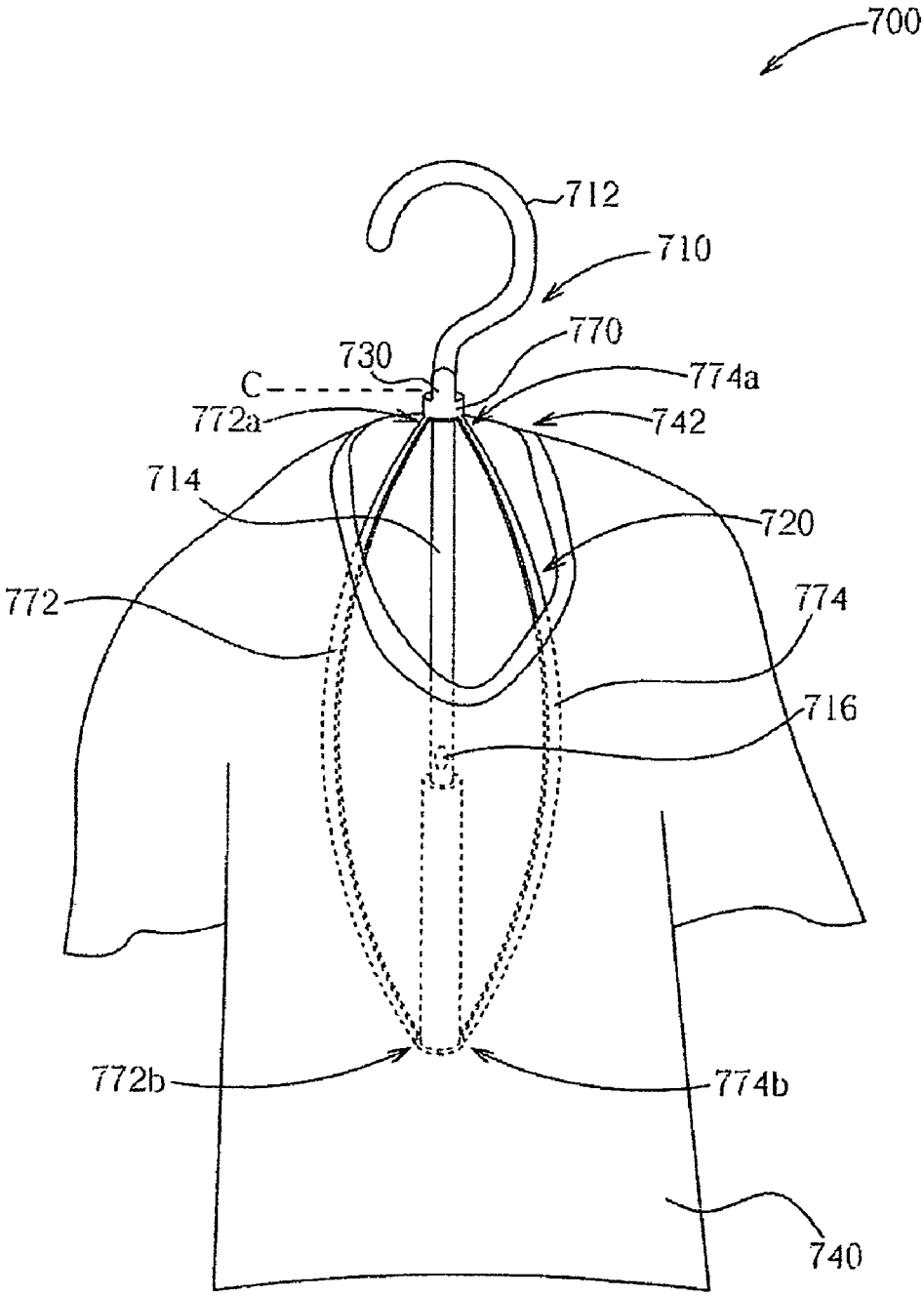
FIG. 7 is an illustration of another clothes hanger of the present invention in the closed-state.
Figure 8:
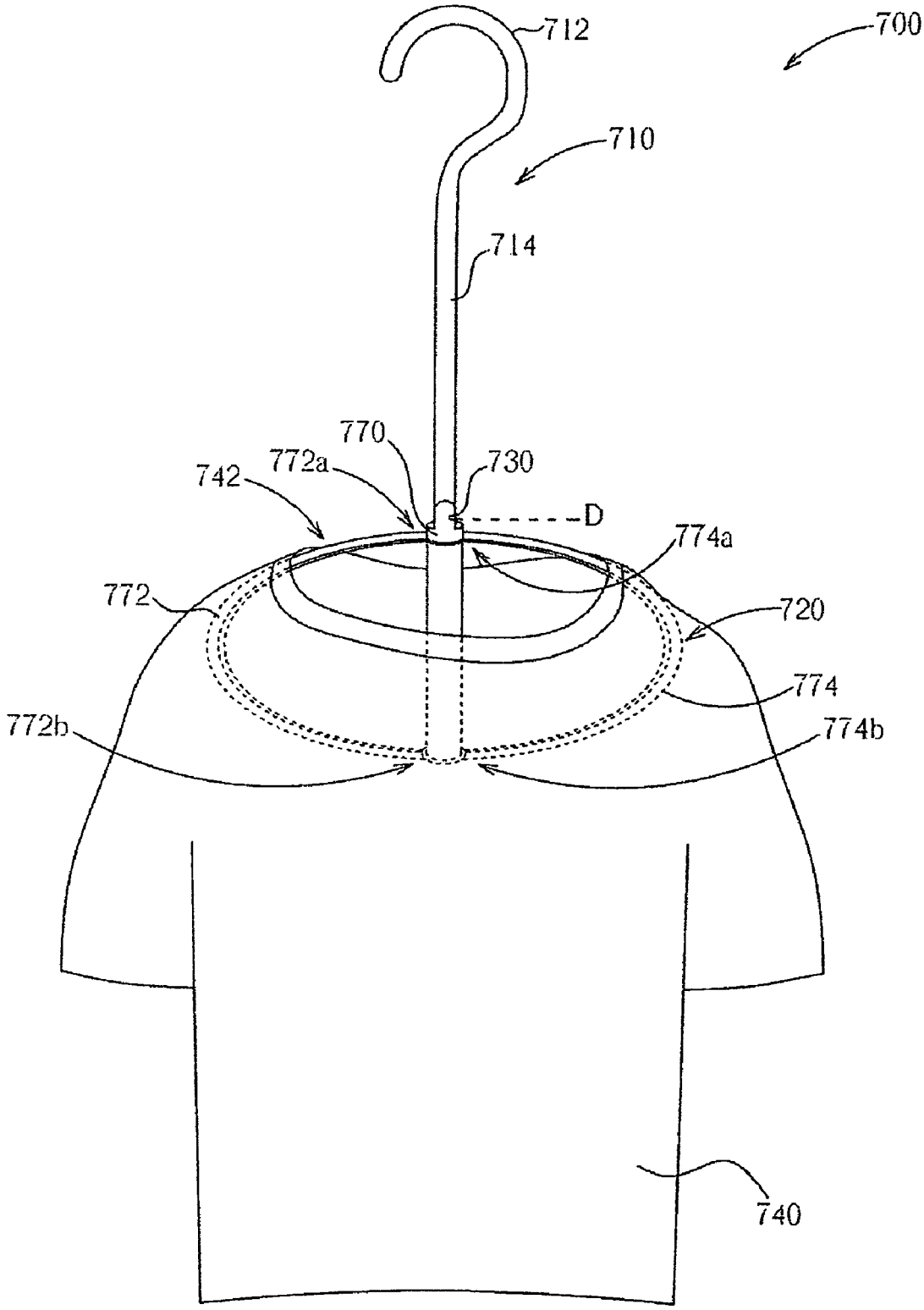
FIG. 8 is an illustration of the clothes hanger shown in FIG. 7 in the open-state.

Please refer to FIG. 7 and FIG. 8. FIG. 7 is an illustration of another clothes hanger 700 of the present invention in the closed-state. FIG. 8 is an illustration of the clothes hanger 700 in FIG. 7 in the open-state. The clothes hanger 700 comprises a hanging rod 710 and a linkage mechanism 720. Similar to the hanging rod 210 in FIG. 2, the hanging rod 710 also comprises a hanging unit 712 and a guiding rod 714 having a recess 716. Therefore, the hanging rod 710 is not further described. Different from the clothes hanger 200 in FIG. 2, there is no folding area at the middle of a first linkage arm 772 and a second linkage arm 774 of the linkage mechanism 720. Also, the first linkage arm 772 and the second linkage arm 774 are made of elastic material. The sliding unit 770 is affixed in an up-down slidable manner to the guiding rod 714. The first linkage arm 772 is installed at a left side of the guiding rod 714, and the second linkage arm 774 is installed at a right side of the guiding rod 714. First ends 772*a*, 774*a* of the first and second linkage arms 772, 774 are connected to the sliding unit 770, and second ends 772*b*, 774*b* of the first and second linkage arms 772, 774 are connected to a lower end of the guiding rod 714. When the sliding unit 770 is free without being forced, the sliding unit 770 is at a third position C, and the middle areas of the first linkage arm 772 and the second linkage arm 774 are close to the guiding rod 714. The linkage mechanism 720 is in a closed-state in the third position C. When the sliding unit 270 is forced to move downward from the third position C, the first linkage arm 772 and the second linkage arm 774 are bent gradually, and the middle areas of the first linkage arm 772 and the second linkage arm 774 move outward. When the sliding unit 270 arrives at a fourth position D and is fixed by the fixing unit 730, the wingspan of the linkage mechanism 720 is large enough to hang the clothes 740 having the neckline 742. The linkage mechanism 720 is in an open-state in the fourth position D. In addition, when the sliding unit 770 is released by the fixing unit 730 from the fourth position D, the sliding unit 770 will be pushed back to the third position C by the first linkage arm 772 and the second linkage arm 774, and the linkage mechanism 720 automatically goes to the closed-state to allow removal of the clothes 740.

Figure 9:
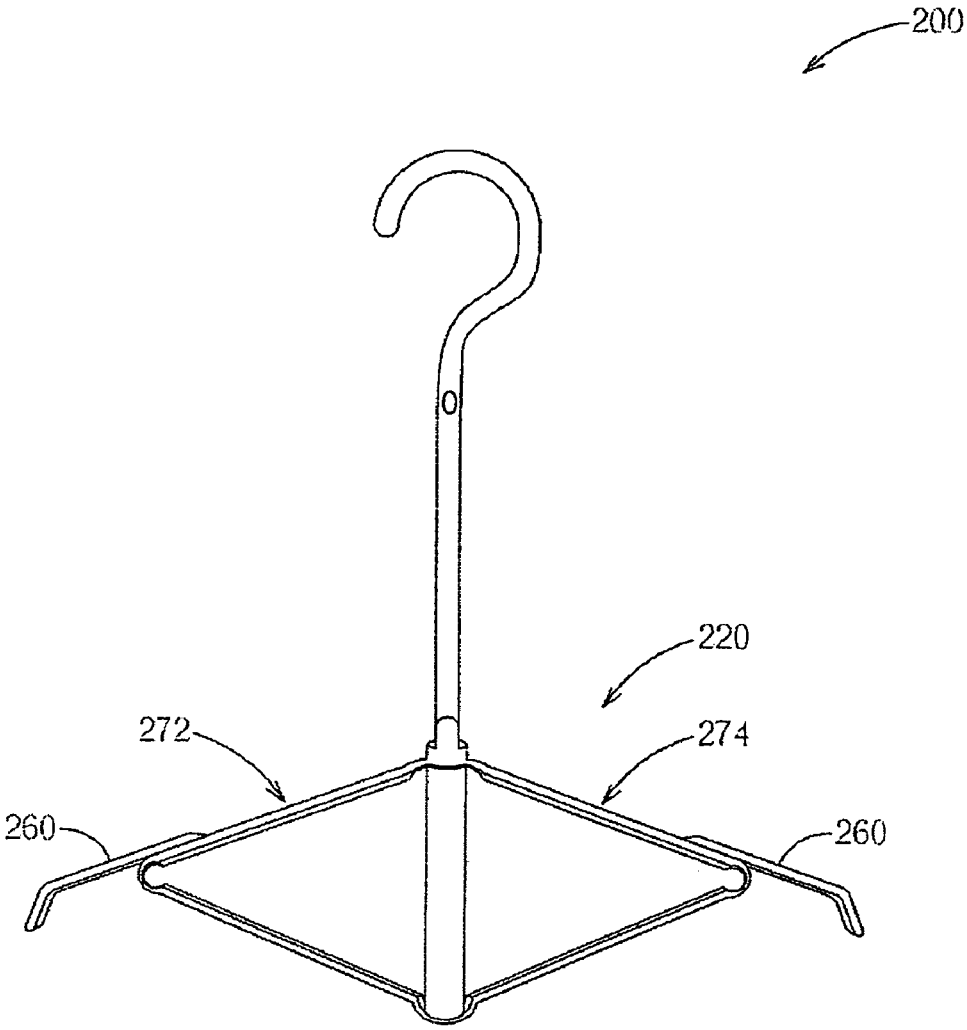
FIG. 9 is an illustration of the clothes hanger shown in FIG. 2 further comprising extension units.
Figure 10:
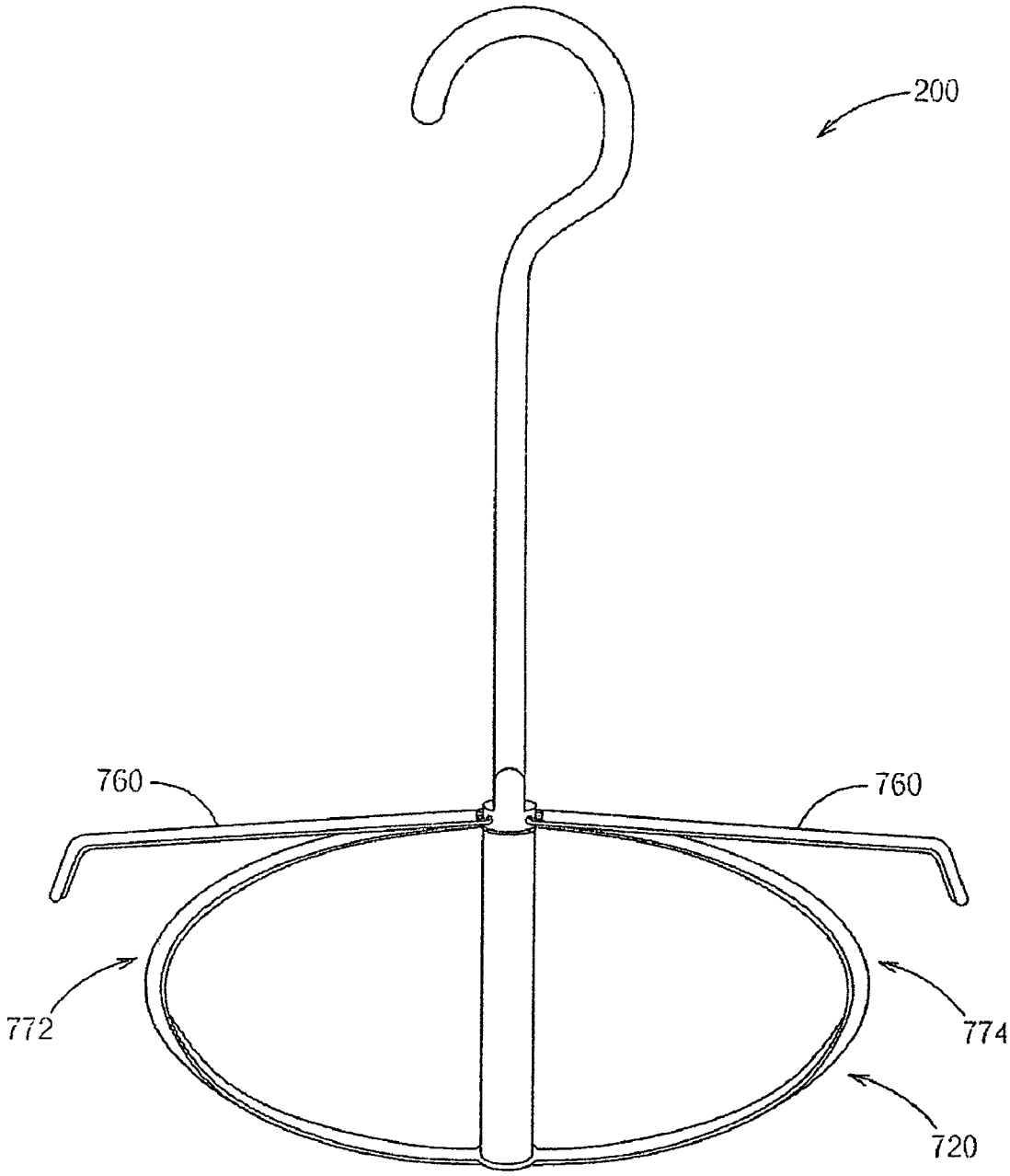
FIG. 10 is an illustration of the clothes hanger shown in FIG. 7 further comprising extension units.

Please refer to FIG. 9 and FIG. 10. FIG. 9 is an illustration of the clothes hanger 200 in FIG. 2 further comprising extension units 260. FIG. 10 is an illustration of the clothes hanger 700 in FIG. 7 further comprising extension units 760. As shown in FIG. 9 and FIG. 10, the clothes hangers 200, 700 further comprise extension units 260, 760 installed on the linkage mechanisms 220, 720. When the clothes hangers 200, 700 are in the open-state, the extension units 260, 760 will extend out of the first linkage arm 272, 772 and the second linkage arm 274, 774 to increase the wingspan of the linkage mechanisms 220, 720. Adding the extension units 260, 760 can also reduce the required length of the first linkage arms 272, 772 and the second linkage arms 274, 774 to save space further.

In contrast to the prior art, the retractable clothes hangers 200, 700 of the present invention can easily hang and unhang clothes by moving the sliding units 270, 770. Also, the necklines 242, 742 of the clothes will not be stretched and thus damaged. In addition, the user can use just one hand to move the sliding units 270, 770 for hanging and unhanging the clothes. Thus, the retractable clothes hangers 200, 700 of the present invention provide more convenience.

Although the present invention has been explained in relation to its preferred embodiments, it is to be understood that many other possible modifications and variations can be made without departing from the spirit and scope of the invention as hereinafter claimed.

What is claimed is:

1. A retractable clothes hanger comprising:

a hanging rod comprising:

a hanging unit; and a guiding rod having an outer circumference and having an upper end connected to the hanging unit;

a linkage mechanism comprising:

a sliding unit affixed in an up-down slidable manner to the guiding rod;

a first linkage arm installed at a left side of the guiding rod, the first linkage arm having a first end connected to the sliding unit and a second end connected to a lower end of the guiding rod; and a second linkage arm installed at a right side of the guiding rod, the second linkage arm having a first end connected to the sliding unit and a second end connected to the lower end of the guiding rod; and a fixing unit fixing the sliding unit at a specific position on the guiding rod, wherein when the sliding unit is moved to a first position corresponding to the guiding rod, the linkage mechanism is in a closed-state, and when the sliding unit is moved to a second position corresponding to the guiding rod, the linkage mechanism is in an open-state for hanging clothes, wherein the sliding unit is annular shaped and includes an inner circumference corresponding to and slideable on the outer circumference of the guiding rod, with the fixing unit including a bump formed in the inner circumference of the sliding unit, with the fixing unit further including a recess formed in the outer circumference of the guiding rod and receiving the bump of the sliding unit.

2. The retractable clothes hanger as claimed in claim 1, wherein the specific position is the first position.

3. The retractable clothes hanger as claimed in claim 1, wherein the specific position is the second position.

4. The retractable clothes hanger as claimed in claim 1 further comprising an extension unit installed on the linkage mechanism for increasing a wingspan of the linkage mechanism in the open-state.

5. The retractable clothes hanger as claimed in claim 1, wherein both the first linkage arm and the second linkage arm comprise:

a sub-upper arm having a first end and a second end, the first end of the sub-upper arm connected to the sliding unit; and a sub-lower arm having a first end and a second end, the first end of the sub-lower arm connected to the second end of the sub-upper arm, the second end of the sub-lower arm connected to the lower end of the guiding rod.

6. The retractable clothes hanger as claimed in claim 5, wherein the linkage mechanism is monolithic at interconnections between the sliding unit and the first ends of the sub-upper arms of the first and second linkage arms, between the second ends of the sub-upper arms and the first ends of the sub-lower arms of the first and second linkage arms, and between the seconds ends of the sub-lower arms of the first and second linkage arms and the lower end of the guiding rod, with the first and second ends of the sub-upper arms and sub-lower arms having cross-sections, and with folding areas at the interconnections being defined by the cross sections of the sub-upper arms and the sub-lower arms at the first and second ends being thinned out.

7. The retractable clothes hanger as claimed in claim 6 further comprising a spring between the first end of the sub-lower arm and the second end of the sub-upper arm of each of the first and second linkage arms for moving the sliding unit.

8. The retractable clothes hanger as claimed in claim 5 further comprising a spring between the first end of the sub-lower arm and the second end of the sub-upper arm of each of the first and second linkage arms for moving the sliding unit.

9. The retractable clothes hanger as claimed in claim 1, wherein the first linkage arm and the second linkage arm are made of elastic material.

10. The retractable clothes hanger as claimed in claim 1, wherein the hanging unit is a hook.

11. The retractable clothes hanger as claimed in claim 1, being made by injection molding.

12. A retractable clothes hanger comprising:

a hanging rod comprising:

a hanging unit; and a guiding rod having an upper end connected to the hanging unit; and a linkage mechanism comprising:

a sliding unit affixed in an up-down slidable manner to the guiding rod;

a first linkage arm installed at a left side of the guiding rod, the first linkage arm having a first end connected to the sliding unit and a second end connected to a lower end of the guiding rod; and a second linkage arm installed at a right side of the guiding rod, the second linkage arm having a first end connected to the sliding unit and a second end connected to the lower end of the guiding rod, wherein both the first linkage arm and the second linkage arm comprise:

a sub-upper arm having a first end and a second end, the first end of the sub-upper arm connected to the sliding unit; and a sub-lower arm having a first end and a second end, the first end of the sub-lower arm connected to the second end of the sub-upper arm, the second end of the sub-lower arm connected to the lower end of the guiding rod, wherein when the sliding unit is moved to a first position corresponding to the guiding rod, the linkage mechanism is in a closed-state, and when the sliding unit is moved to a second position corresponding to the guiding rod, the linkage mechanism is in an open-state for hanging clothes, wherein the linkage mechanism is monolithic at interconnections between the sliding unit and the first ends of the sub-upper arms of the first and second linkage arms, between the second ends of the sub-upper arms and the first ends of the sub-lower arms of the first and second linkage arms, and between the seconds ends of the sub-lower arms of the first and second linkage arms and the lower end of the guiding rod, with the first and second ends of the sub-upper arms and sub-lower arms having cross-sections, and with folding areas at the interconnections being defined by the cross sections of the sub-upper arms and the sub-lower arms at the first and second ends being thinned out.

13. The retractable clothes hanger as claimed in claim 12 further comprising a spring between the first end of the sub-lower arm and the second end of the sub-upper arm of each of the first and second linkage arms for moving the sliding unit.

14. The retractable clothes hanger as claimed in claim 12, wherein the first linkage arm and the second linkage arm are made of elastic material.

15. The retractable clothes hanger as claimed in claim 12, wherein the hanging unit is a hook.

16. The retractable clothes hanger as claimed in claim 12 further comprising an extension unit installed on the linkage mechanism for increasing a wingspan of the linkage mechanism in the open-state.

17. A retractable clothes hanger comprising:

a hanging rod comprising:

a hanging unit; and a guiding rod having an upper end connected to the hanging unit;

a linkage mechanism comprising:

a sliding unit affixed in an up-down slidable manner to the guiding rod;

a first linkage arm installed at a left side of the guiding rod, the first linkage arm having a first end connected to the sliding unit and a second end connected to a lower end of the guiding rod; and a second linkage arm installed at a right side of the guiding rod, the second linkage arm having a first end connected to the sliding unit and a second end connected to the lower end of the guiding rod, wherein both the first linkage arm and the second linkage arm comprise:

a sub-upper arm having a first end and a second end, the first end of the sub-upper arm connected to the sliding unit; and a sub-lower arm having a first end and a second end, the first end of the sub-lower arm connected to the second end of the sub-upper arm, the second end of the sub-lower arm connected to the lower end of the guiding rod, and a spring between the first end of the sub-lower arm and the second end of the sub-upper arm of each of the first and second linkage arms for moving the sliding unit, wherein when the sliding unit is moved to a first position corresponding to the guiding rod, the linkage mechanism is in a closed-state, and when the sliding unit is moved to a second position corresponding to the guiding rod, the linkage mechanism is in an open-state for hanging clothes.

18. The retractable clothes hanger as claimed in claim 17, wherein the first linkage arm and the second linkage arm are made of elastic material.

19. The retractable clothes hanger as claimed in claim 17, wherein the hanging unit is a hook.

20. The retractable clothes hanger as claimed in claim 17 further comprising an extension unit installed on the linkage mechanism for increasing a wingspan of the linkage mechanism in the open-state.

* * * * *